US005394478A

United States Patent [19]

Hathaway et al.

[11] Patent Number: 5,394,478

[45] Date of Patent: Feb. 28, 1995

[54] LOW FREQUENCY SOUND GENERATION SYSTEM FOR USE IN VEHICULAR PASSENGER COMPARTMENTS

[75] Inventors: Dana B. Hathaway, Amesbury; Lawrence B. Nile, Newburyport, both of Mass.

[73] Assignee: Advanced Composite Audio, Inc., Hampton Falls, N.H.

[21] Appl. No.: 977,677

[22] Filed: Nov. 18, 1992

[51] Int. Cl.[6] ..... H04R 25/00; H04R 7/00

[52] U.S. Cl. ..... 381/154; 381/86; 181/160; 181/182

[58] Field of Search ..... H04B 1/00; G10K 13/00

[56] References Cited

U.S. PATENT DOCUMENTS

| | | | |
|---|---|---|---|
| 4,493,389 | 1/1985 | Del Rosario | 381/86 |
| 4,924,962 | 5/1990 | Terai et al. | 181/199 |
| 5,004,066 | 4/1991 | Furukawa | 381/159 |

OTHER PUBLICATIONS

Bailey, A. R., "A Non-resonant Loudspeaker Enclosure Design", *High Fidelity Designs,* (London), I.P.C. Business Press Ltd., pp. 86-91.

Colloms, Martin, "Acoustic Loading and Low Frequency System Analysis", (London), Pentech Press Limited, pp. 86-88.

*Primary Examiner*—Curtis Kuntz
*Assistant Examiner*—Ping W. Lee
*Attorney, Agent, or Firm*—Samuels, Gauthier & Stevens

[57] ABSTRACT

A system for low frequency sound production in vehicular passenger compartments, comprising an electrodynamic driver, having a first acoustic mass and a first acoustic compliance; and a Helmhotz resonator, affixed to one side of said electrodynamic driver means and having a second acoustic mass and a second acoustic compliance, the second acoustic mass being affixed to a baffle facing the passenger compartment. The first and second acoustic mass have substantially similar magnitudes, and the Helmholtz resonator and the electrodynamic driver being substantially tuned to the highest and lowest frequencies of a desired passband, respectively, so as to provide a substantially flat pressure vas. frequency characteristic when the passenger compartment has dimensions generally smaller than one eighth wavelength of the lowest frequency.

4 Claims, 8 Drawing Sheets

LOW FREQUENCY SOUND GENERATION SYSTEM FOR USE IN VEHICULAR PASSENGER COMPARTMENTS

BACKGROUND OF THE INVENTION

The present invention relates to an electroacoustic mechanism for the production of low frequency sound in the acoustic spaces typical of the passenger compartments of vehicles. Although the technique described herein is expected to be used principally for high-fidelity music reproduction, it also is particularly attractive for applications in active noise cancellation, and may allow significant weight savings over conventional sound deadening. An actual device constructed according to these teachings has been shown to exhibit in-vehicle pressure response flat to 11 Hz, with extremely high displacement power handling in the pass band with the enclosure volume being one-half cubic foot.

The production of low frequency sound in domestic room sized acoustic spaces presents physical problems that are well understood. The solution to these problems all ultimately involve moving large amounts of air, i.e. in acoustics referred to as volume velocities of air.

The particular acoustic characteristics of vehicular passenger spaces is less generally understood. Typical existing practice has largely been a simple transference of techniques and actual devices used in domestic, large room applications, with little, if any, regard for the unique conditions and requirements of vehicular passenger compartments. In the development of the present invention, the analysis, simulation, and actual measurement of these spaces has yielded a new and optimal solution for the production of sound in this specific environment.

In adapting home sound equipment for vehicle use, modifications have typically been limited to improvements in mounting, or the substitution of plastic cones for paper in order to improve moisture resistance. Enhancements for a desired frequency response have largely been in the form of electronic equalization prior to amplification. Although this technique affords great flexibility in "tuning" a given system, it necessarily limits the maximum power handling over the part of the spectrum which has been boosted. This can become a serious problem at low frequencies where large driver excursions may be required to achieve a desired response.

Acoustical considerations have largely been based on a system's free field behavior, where the transducer may be considered a point source. In such an environment, flat acoustic pressure response is achieved by driving the air load under a constant acceleration regime.

In automotive applications, the typical practice has been to operate the system below resonance, where the driver operates in a constant displacement regime. Such systems, at best, exhibit a rolloff asymptotically approaching 12 dB./octave under free field conditions, which roughly compliments the rising response typical of vehicular interiors, as described below. The chief limitation of these systems lies in the large excursions required to produce a given volume velocity. Additionally, the enclosures for these systems tend to be rather large; on the order of several cubic feet. It should be noted that the vented box systems, as well as higher order band pass designs, exhibit asymptotic free-field low frequency rolloffs greater than 12 dB./octave, which makes them undesirable for this application.

The techniques for low frequency point sources are well known conventional systems include infinite baffle/closed box enclosures, bass reflex/vented box enclosures, and a recent variant of the vented box, the so-called band pass enclosure. All the above enclosures are designed on the premise that the air load is essentially a mass, with a small additional resistive component which actually represents the audible component. Measurement of these systems' far field response has been greatly facilitated by two techniques which do not require the use of anechoic chambers. One technique, utilizes the nearfield pressure response as a predictor of farfield response. The other technique, uses the second derivative of the enclosure's internal pressure, which, as will be demonstrated, has particular significance in the development of the present invention.

The following describes the peculiar behavior of the small acoustic spaces typical of automotive interior listening environments. Acoustic spaces with physical dimensions less than one-eighth wavelength of sound in air can be characterized as a constant acoustic compliance (Cab) (or as the reciprocal property, stiffness):

$$Cab = Vb/ro*c \quad 2 \qquad \text{(EQ. 1)}$$

wherein, Vb is the internal volume of air, ro is the density of air (1.18 kg/m^ 3), and c is the velocity of sound in air (345 m/s).

In order to produce a constant sound pressure (Pb) in an acoustic environment characterized by a constant acoustic compliance we need a sound source whose volume velocity varies inversely with frequency, as shown in the relationship:

$$Pb = Uo/f*2*pi*Cab \qquad \text{(EQ. 2)}$$

But the Uo volume velocity of the sound source energizing this constant compliance space is related to outside acoustic pressure P out by the following relationship:

$$Uo = Pout/2*pi*f \qquad \text{(EQ. 3)}$$

Combining equations (1) and (2) we see that the sound pressure inside a constant compliance acoustic space varies inversely with the square of frequency for outside sound pressure that crosses the boundary of the constant compliance acoustic space.

$$Pb = Pout/f2*Cab \qquad \text{(EQ. 4)}$$

In actual practice, the dimensions of typical passenger compartments approach the $\frac{1}{8}$ wavelength requirement over the frequency range of 15 to 45 Hz.

Accordingly, it has been found, based on measurements of the acoustic transfer function (i.e.,sound pressure response/sound pressure driving source) of various vehicular acoustic spaces, that the relationship of driving source pressure to measured acoustic space pressure will vary between a first order, inverse with frequency, and a second order, inverse with squared frequency characteristic. These observations are consistent with conventional in-box acoustic pressure measurements, wherein the internal pressure of an enclosure of small dimensions varies as the partial second integral of the external farfield pressure. In the present invention, the interior of the vehicular cabin is analogous to the interior of the cited enclosure. The variations are due to behavior which is analogous to "compliance shift", which is due to the layer of air in the immediate proximity of the radiating element not exhibiting uniform compression with respect to the rest of the enclosure. This effect will be dependent upon the specific physical configuration of the acoustic space in various vehicles.

SUMMARY OF THE INVENTION

The acoustic pressure response and motional behavior of an electrodynamic driver are both strongly affected by the driver's loading. Applicants have found that flat pressure response and reduced driver excursion in an air load typical of a passenger compartment may be achieved with an electrodynamic driver energizing a Helmholtz resonator, under the following conditions: 1.) the resonator and driver are tuned to the highest and lowest frequencies of interest, respectively; 2.) the effective acoustic moving masses of the driver and the resonator are approximately equivalent. The electrodynamic driver means may consist of a single driver unit, or a plurality of drivers, where the operating properties of each driver combine to function effectively as a single unit. The moving mass of the resonator serves as the sole acoustical coupling via a baffle into the passenger compartment. The resonance of the Helmholtz chamber plays the dominant role in determining the system's output, with the resonance of the driver playing a secondary one. The output characteristic within the desired passband is that of a partial, second order differentiator, rolling off at a rate between 6 and 12 dB./octave, with the slope being determined by the relative impedance levels of the two resonant systems. This provides the compliment to the response of the passenger compartment.

Similarly,the acoustical impedance of the resonator will load and suppress the mechanical motion of the driver: this resulting motion is effectively one slope of a broad motional null centered at the chamber's resonant frequency. The breadth of this null is due largely to the dominance of the chamber's reactances over the negligible contribution of the electrodynamic driver motional reactances.

The driver, therefore, is principally a pressure generator; it exhibits very little mechanical displacement over the operating passband, being typically an order of magnitude smaller than a closed box system with a similar rolloff.

If the highest frequency of interest is 100 Hz. or so, the Helmholtz chamber will typically be one half cubic foot in interior volume. This state of affairs in not simply a side effect, it is essential for the proper operation of the system.

One of the advantages of the present invention, therefore, is that it simultaneously provides response equalization and improved displacement power handling in an extremely compact and simple configuration.

The object of this invention is a sound system for uniform low frequency sound production in the small acoustic spaces exhibiting the substantially constant compliance behavior typical of vehicular passenger environments. It is a further object of this invention to provide a compact and easily installed physical package for such a system. It is yet a further object of this invention to provide power handling which is superior to conventional systems over the entire range of frequencies produced.

DETAILED DESCRIPTION OF THE ILLUSTRATED EMBODIMENTS

Figure 1:
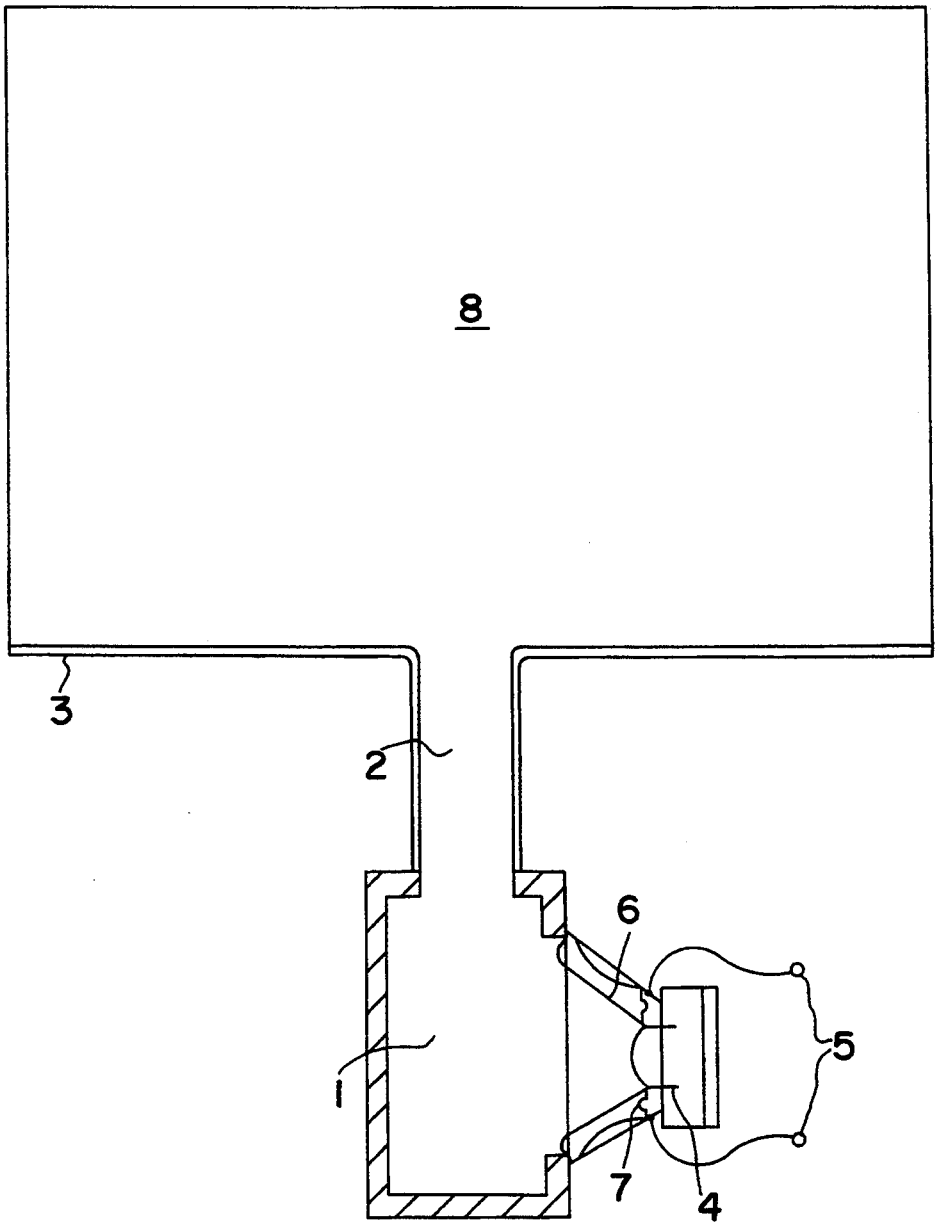
FIG. 1 shows a first embodiment of the system in accordance with the present invention.
Figure 2A:
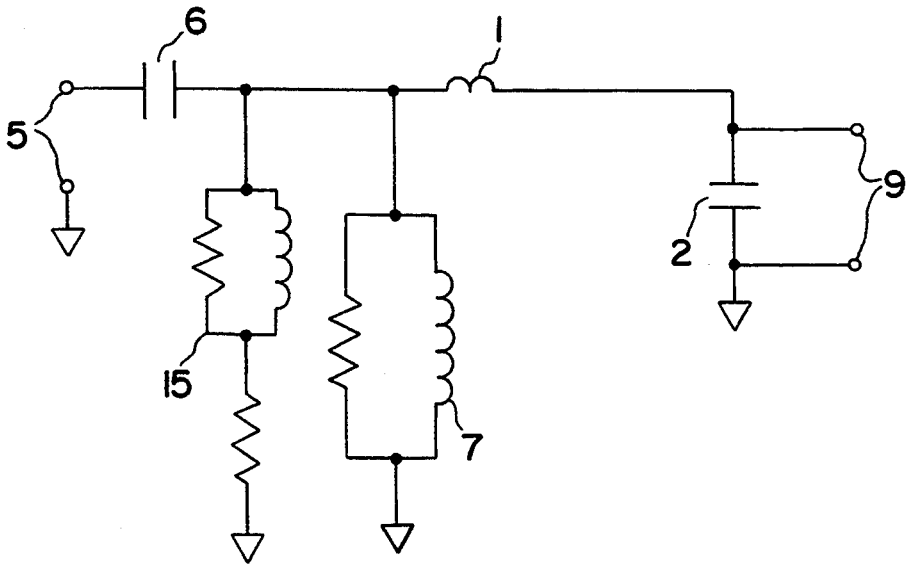
FIG. 2A shows an electrical equivalent circuit of the first embodiment operating as a pressure source in a free field environment.
Figure 2B:
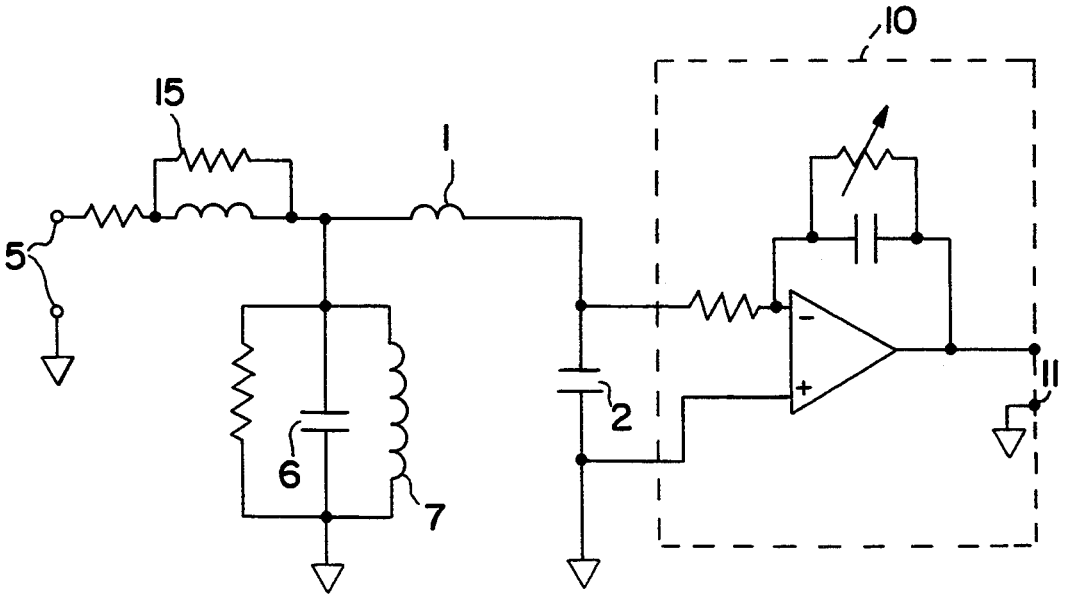
FIG. 2B shows an electrical equivalent circuit of the first embodiment operating as a pressure source in an enclosed passenger compartment.

A first embodiment of the present invention is depicted schematically in FIG. 1, and in its electrical equivalent circuit as shown in FIGS. 2A and 2B. Acoustic chamber compliance 1 and acoustic port inertance 2 comprise the Helmholtz resonator, which is coupled through baffle 3 into a passenger compartment 8. The Helmholtz resonator is energized by electrodynamic driver 4 with electrical input 5, whose relevant acoustic elements are moving mass 6 represented by the cone, and compliance 7, represented as the cone's mechanical suspension.

Figure 3:
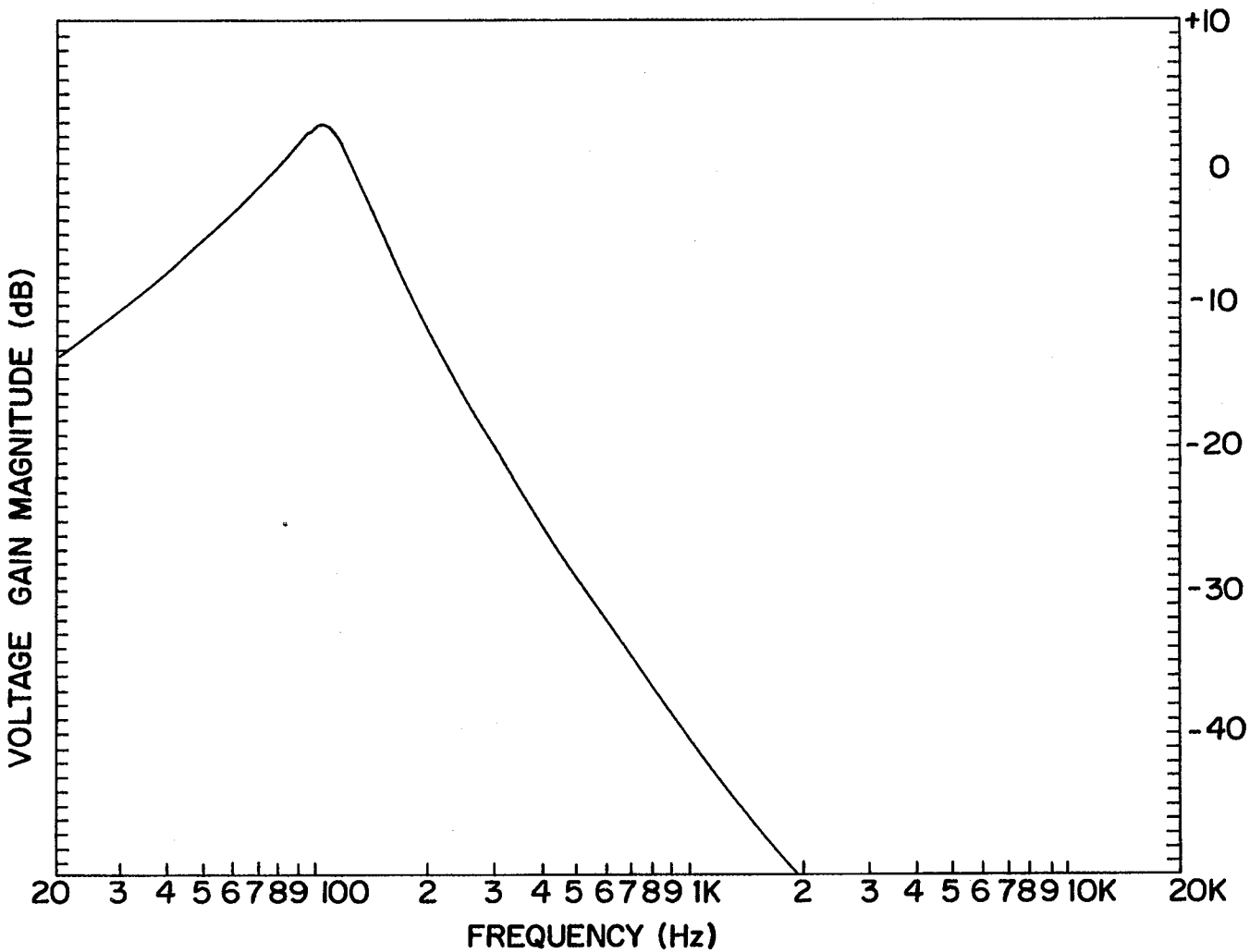
FIG. 3 is a graph of the free field acoustical pressure response simulated by the electrical equivalent model of FIG. 2B.
Figure 4:
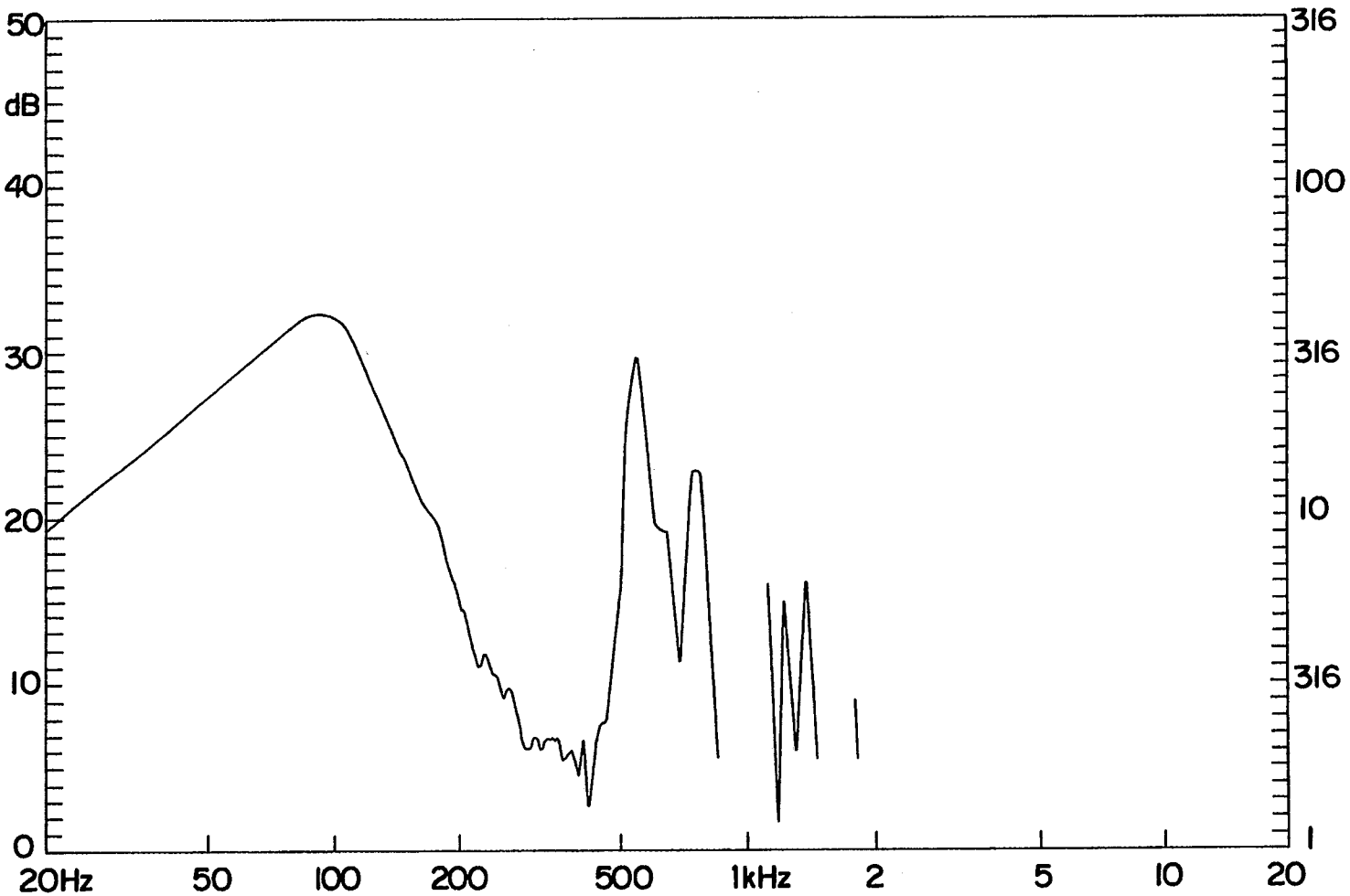
FIG. 4 is a graph of the actual acoustic pressure response of the present invention in a free field environment.
Figure 6:
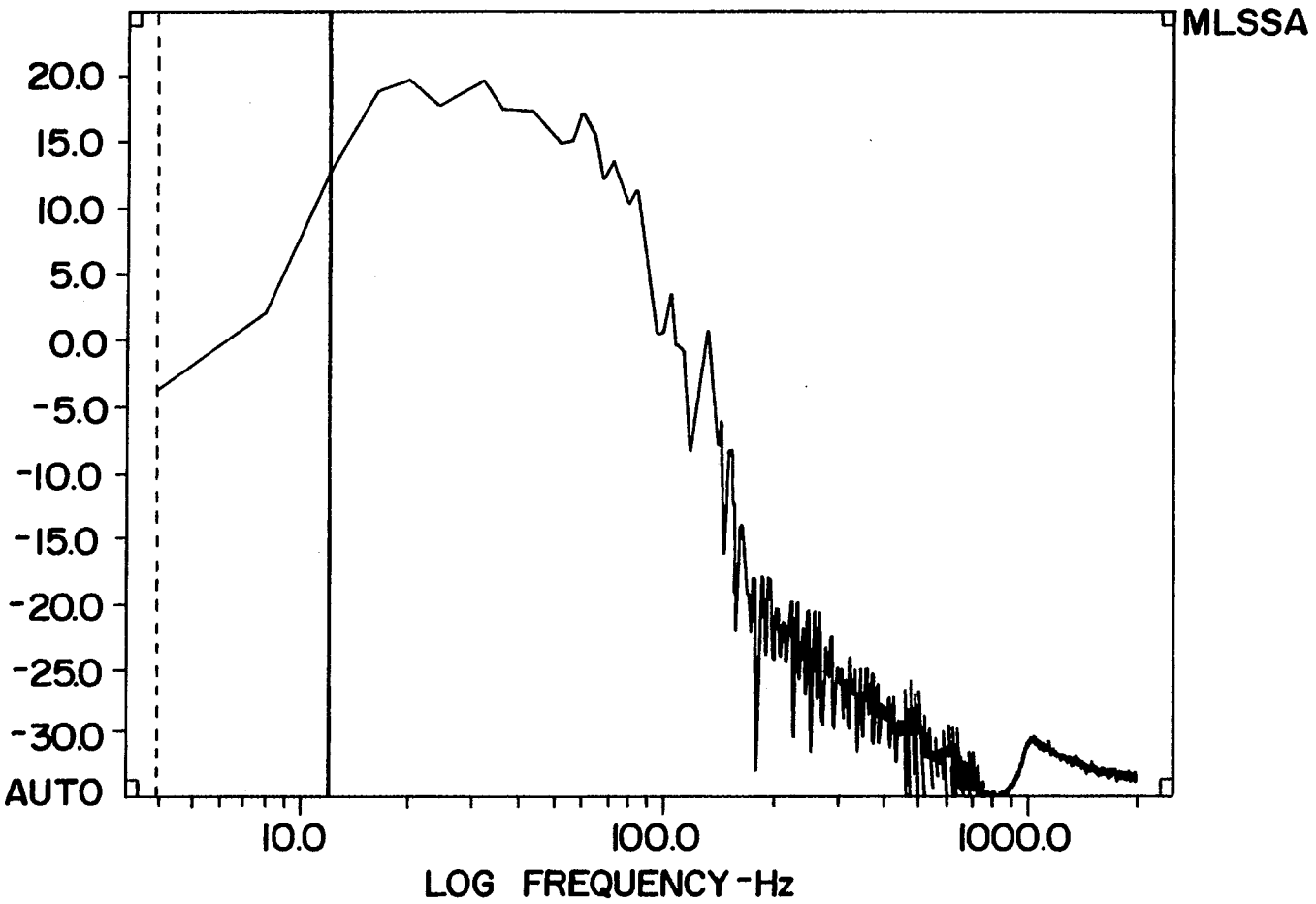
FIG. 6 is a graph of the actual acoustic pressure response in a system installed in a vehicle similar to that of FIG. 5.
Figure 7:
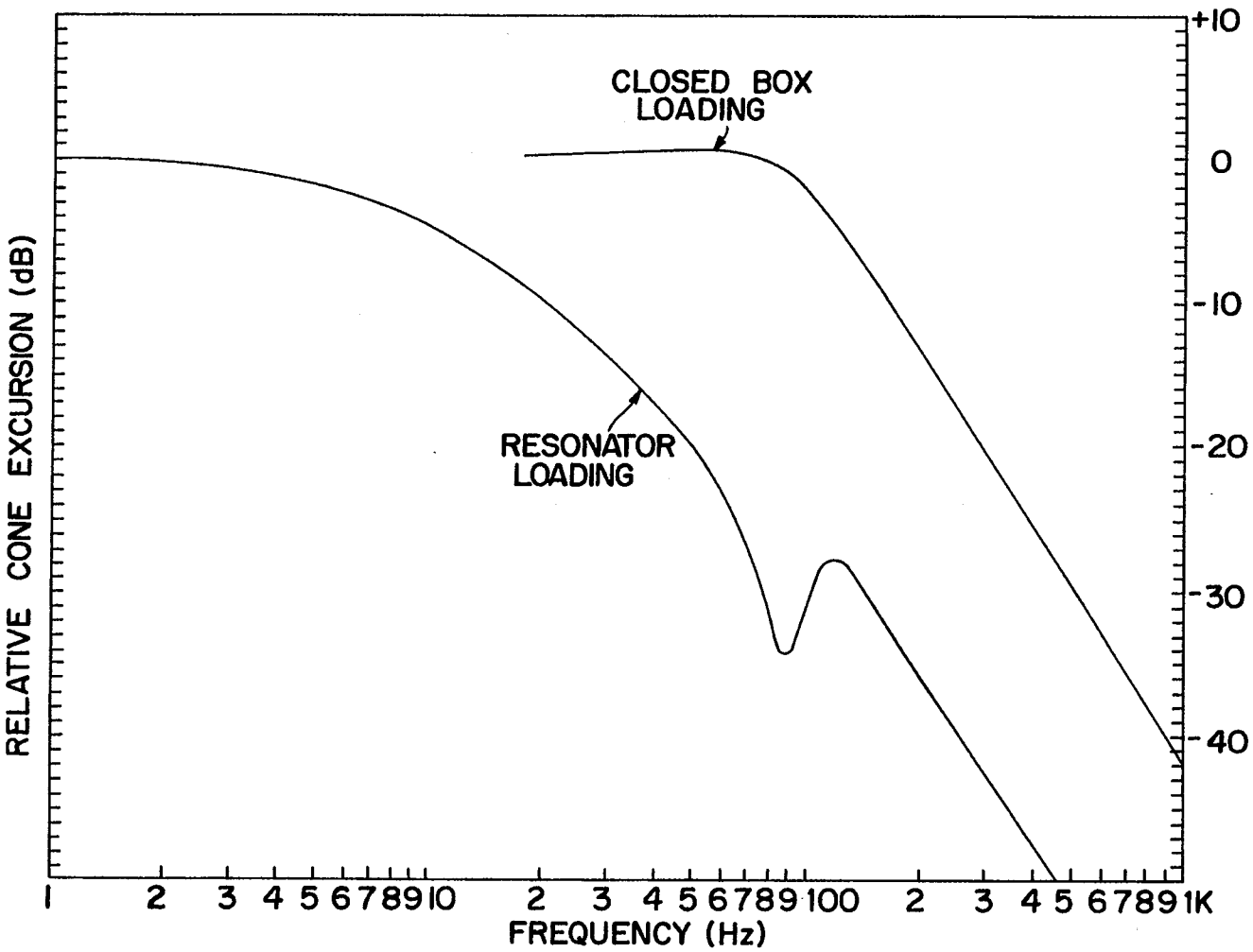
FIG. 7 is a graph of the relative cone excursions of the present invention vs. a sealed box tuned to provide approximately the same pressure response.

The driver 4 is energized at input terminals 5 through the complex voice coil impedance 15, as shown in FIG. 2B, and in transposed form in FIG. 2A. In the electrical equivalent circuit of FIGS. 2A and 2B, compliances 1 and 7 are represented as inductances 1' and 7' and inertances (or masses) 2 and 6 are shown as capacitance 2' and 6'. The driver's topology shown in FIG. 2A is transposed to show an acoustical volume acceleration at output 9, which is, in turn, equivalent to pressure response under free field loading. This output is shown via electrical equivalent simulation in the graph of FIG. 3, and in actual measurement in the graph of FIG. 4. The topology shown in FIG. 2B is redrawn so as to represent the acoustical output through the port 2'' as acoustical volume velocity, which, in turn, provides the first integration of pressure as described above. The second, partial integration is shown by the circuit 10, which produces the passenger compartment acoustic pressure output at 11. An actual response of a system installed in a vehicle is shown in FIG. 6, which depicts the equivalization provided by the passenger compartment loading.

Figure 5:
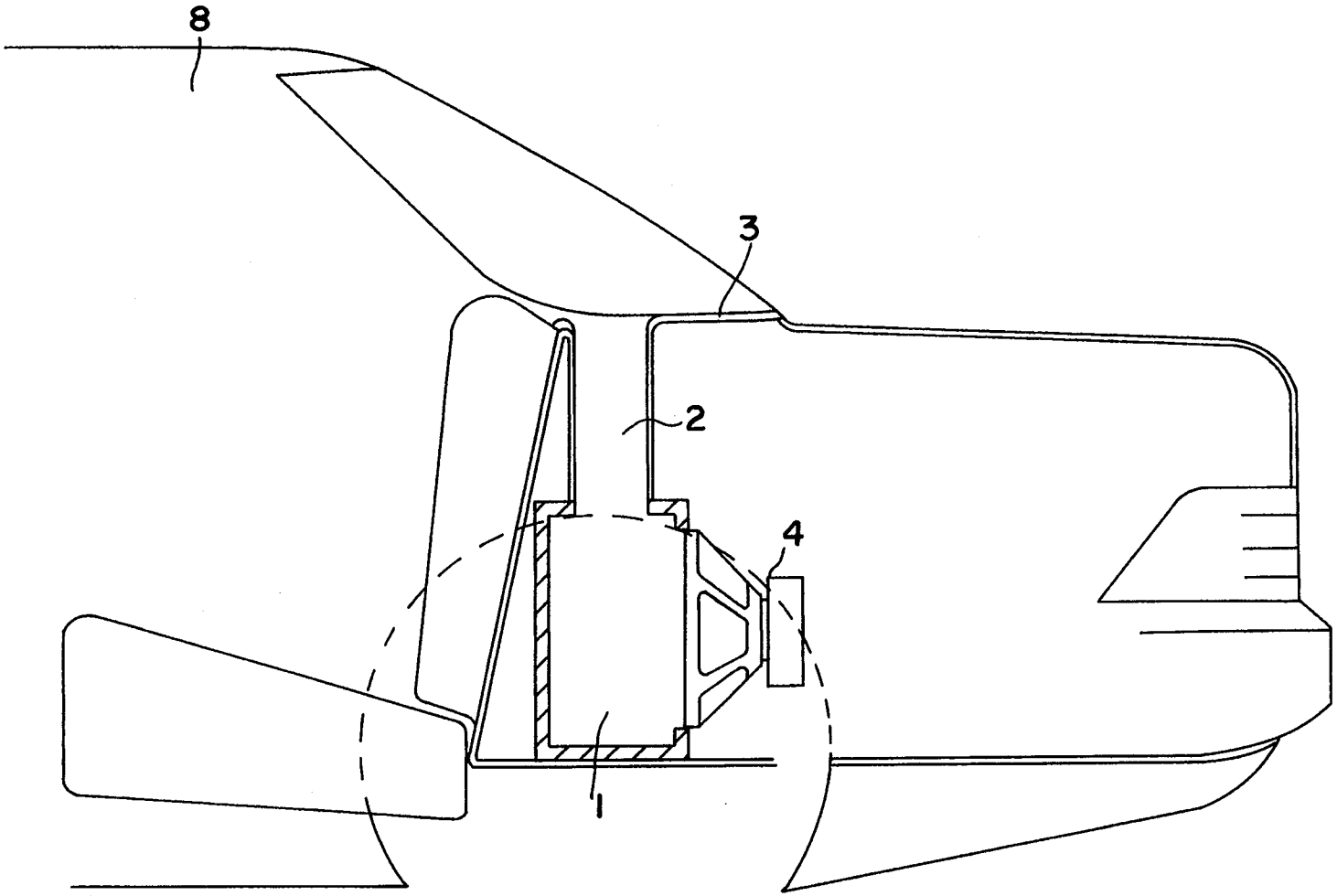
FIG. 5 shows the system of FIG. 1 installed in a vehicle.

As mentioned above, the size of such a system can be made very small. Typical systems can be under one cubic foot, overall. A particularly attractive situation exists in automotive sedans which have a separate, enclosed trunk compartment. In such a vehicle, the wall between the passenger compartment 8 and the enclosed trunk provide the baffle 3 to prevent the driver backwave from entering the passenger compartment 8. The resonator can then be coupled to the passenger compartment through a flexible duct which forms radiating mass element 2 of the resonator, as shown in FIG. 5. This allows convenient placement of the system in an out-of-the-way corner of the trunk, without significant reduction of storage space.

Figure 8:
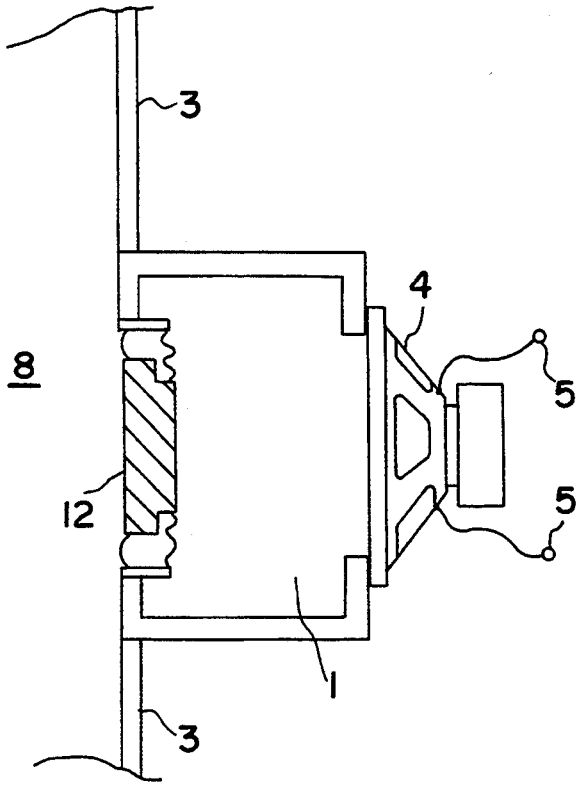
FIG. 8 shows a second embodiment of the system utilizing a passive radiator as the resonator mass.

A second embodiment is shown wherein the radiating acoustic mass 2 is replaced by a passive radiator mass 12, as shown in FIG. 8. This embodiment may be useful where it is not desired to use a duct as depicted in the first preferred embodiment.

Figure 9:
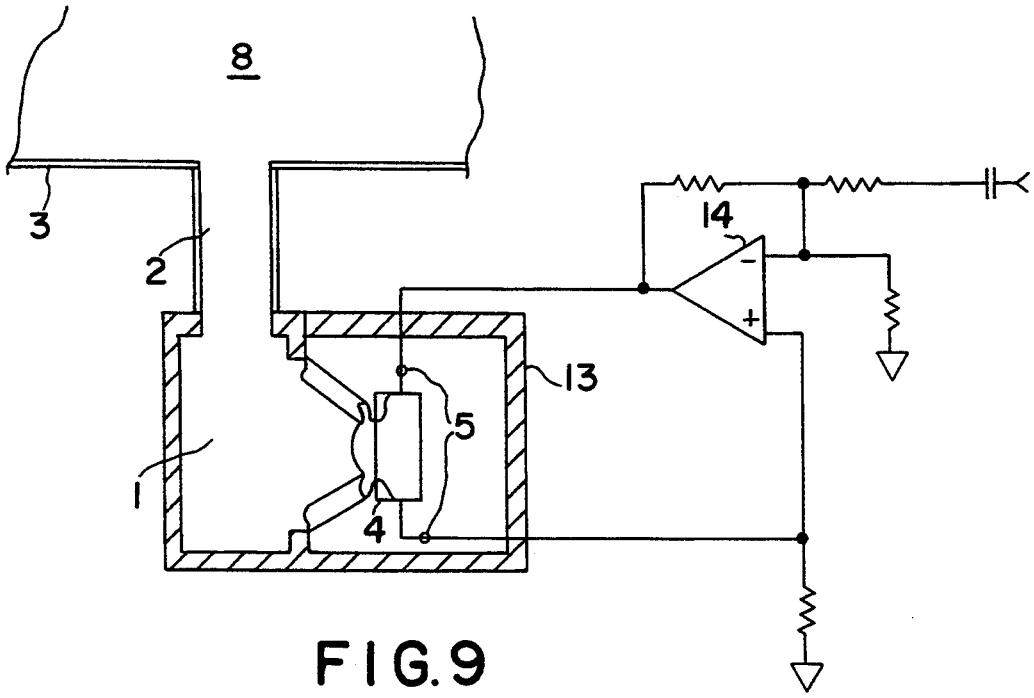
FIG. 9 shows a third embodiment of the present invention which uses a backwave enclosure and a motional feedback circuit to replicate the cone motion of the first embodiment.

A third embodiment is shown wherein eh backwave of the electrodynamic driver 4 is contained by an enclosure 13, as shown in FIG. 9. The driver is then operated within a motional or acoustic feedback loop, so as to essentially replicate the motional characteristics of the driver in the open back system This can be done conventionally by using a negative output impedance amplifier 14 to null the voice coil impedance 15. As in the first and second embodiments, driver loading and acoustic output is thus dominated by the resonator. Other feedback techniques may be used, alternately, without substantially departing from these teachings. This embodiment is useful in vehicles without separate baggage compartments, such as trucks, hatchbacks, and small aircraft.

It will be readily appreciated by those skilled in the art that modifications may be made to the illustrated embodiments which do not depart from the teachings of the present invention.

What is claimed is:

1. A system for low frequency sound production in a vehicular passenger compartment, comprising:

electrodynamic driver means, having a first acoustic mass means and a first acoustic compliance; and Helmholtz resonator means, affixed to only one radiating side of said electrodynamic driver means and having a second acoustic mass means and a second acoustic compliance means, said second acoustic mass means being affixed to a baffle facing said passenger compartment, said second acoustic mass means providing the sole acoustic output into said passenger compartment, wherein said first and second acoustic mass means have substantially similar magnitudes, and said Helmholtz resonator means and said electrodynamic driver means being substantially tuned to the highest and lowest frequencies of a desired passband, respectively, thus providing a spaced pole pair with a transition region that yields a substantially flat pressure vs. frequency characteristic in said passenger compartment, in response to one eighth of the radiated wavelengths exceeding the dimensions of said passenger compartment.

2. The system of claim 1, wherein said second acoustic mass means is the air mass in a flexible duct into said passenger compartment.

3. The system of claim 1, wherein said second acoustic mass means is a passive radiator.

4. The system of claim 1, wherein the backwave of said electrodynamic driver means is contained in an enclosure and said electrodynamic driver means is operated in a motional feedback loop to achieve said tuning.

* * * * *